US009279298B2

(12) United States Patent
Lewis et al.

(10) Patent No.: US 9,279,298 B2
(45) Date of Patent: Mar. 8, 2016

(54) WELL CONTROL SYSTEMS AND METHODS

(75) Inventors: Derrick W. Lewis, Conroe, TX (US); Ronald J. Dirksen, Spring, TX (US); David Michael Radley, Huddersfield (GB); James R. Lovorn, Tomball, TX (US); Fredrick D. Curtis, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 473 days.

(21) Appl. No.: 13/392,900

(22) PCT Filed: Jan. 5, 2010

(86) PCT No.: PCT/US2010/020122

§ 371 (c)(1),
(2), (4) Date: Feb. 28, 2012

(87) PCT Pub. No.: WO2011/084153

PCT Pub. Date: Jul. 14, 2011

(65) Prior Publication Data

US 2012/0165997 A1 Jun. 28, 2012

(51) Int. Cl.
*E21B 21/08* (2006.01)
*E21B 44/00* (2006.01)

(52) U.S. Cl.
CPC ..... *E21B 21/08* (2013.01); *E21B 44/005* (2013.01)

(58) Field of Classification Search
USPC ..... 700/98, 282; 175/48, 40, 50, 25, 38; 166/250.07, 250.15
See application file for complete search history.

(56) References Cited

U.S. PATENT DOCUMENTS

| | | | | |
|---|---|---|---|---|
| 4,355,784 | A | 10/1982 | Cain | |
| 6,173,768 | B1 | 1/2001 | Watson | |
| 6,257,354 | B1 * | 7/2001 | Schrader et al. | 175/38 |
| 6,367,532 | B1 * | 4/2002 | Miyake | 156/497 |
| 6,371,204 | B1 * | 4/2002 | Singh et al. | 166/250.03 |
| 6,484,816 | B1 | 11/2002 | Koederitz | |

(Continued)

FOREIGN PATENT DOCUMENTS

| | | | |
|---|---|---|---|
| EP | 1936112 | A2 | 6/2008 |
| WO | 2009111412 | A2 | 9/2009 |

OTHER PUBLICATIONS

Mccaskill etal. , Managing wellborepressure while drilling, Mar./Apr. 2006, Drilling Contractor, p. 40-42.*

(Continued)

*Primary Examiner* — Kidest Bahta
(74) *Attorney, Agent, or Firm* — Chamberlain Hrdlicka

(57) ABSTRACT

A well control method can include removing from a wellbore an undesired influx from a formation into the wellbore, determining a desired pressure profile in real time with a hydraulics model, and automatically operating a flow choking device while removing the undesired influx from the wellbore, thereby influencing an actual pressure profile toward the desired pressure profile. Another well control method can include removing out of a wellbore an undesired influx from a formation into the wellbore, determining a desired wellbore pressure with a hydraulics model, the desired wellbore pressure preventing further influx into the wellbore while removing the undesired influx from the wellbore, and automatically operating a flow choking device while removing the undesired influx from the wellbore, thereby influencing an actual wellbore pressure toward the desired wellbore pressure.

48 Claims, 4 Drawing Sheets

(56) References Cited

U.S. PATENT DOCUMENTS

| | | | | |
|---|---|---|---|---|
| 6,755,261 | B2 | 6/2004 | Koederitz | |
| 6,814,142 | B2 * | 11/2004 | Paulk et al. | 166/250.07 |
| 8,127,831 | B2 * | 3/2012 | Haeberle et al. | 166/51 |
| 8,286,704 | B2 * | 10/2012 | Chan et al. | 166/263 |
| 8,490,719 | B2 * | 7/2013 | Duhe et al. | 175/57 |
| 8,631,877 | B2 * | 1/2014 | Gewily | 166/387 |
| 2002/0092653 | A1 * | 7/2002 | Scott et al. | 166/338 |
| 2002/0092655 | A1 | 7/2002 | Fincher et al. | |
| 2003/0098181 | A1 | 5/2003 | Aronstam et al. | |
| 2003/0168258 | A1 * | 9/2003 | Koederitz | 175/38 |
| 2003/0220742 | A1 | 11/2003 | Niedermayr et al. | |
| 2003/0234120 | A1 | 12/2003 | Paluch et al. | |
| 2004/0040746 | A1 | 3/2004 | Niedermayr et al. | |
| 2005/0092523 | A1 * | 5/2005 | McCaskill et al. | 175/38 |
| 2005/0098349 | A1 | 5/2005 | Krueger et al. | |
| 2006/0207795 | A1 | 9/2006 | Kinder et al. | |
| 2007/0168056 | A1 | 7/2007 | Shayegi et al. | |
| 2008/0041149 | A1 | 2/2008 | Leuchtenberg | |
| 2008/0060846 | A1 | 3/2008 | Belcher et al. | |
| 2009/0159334 | A1 | 6/2009 | Alberty | |
| 2009/0166031 | A1 * | 7/2009 | Hernandez | 166/250.01 |

OTHER PUBLICATIONS

International Search Report with Written Opinion issued Oct. 13, 2010 for PCT Patent Application No. PCT/US10/020122, 13 pages.
International Search Report with Written Opinion issued Jun. 17, 2011 for PCT Patent Application No. PCT/US10/056433, 9 pages.
International Search Report with Written Opinion issued Dec. 21, 2011 for PCT Patent Application No. PCT/US11/031790, 15 pages.
International Search Report with Written Opinion issued Feb. 17, 2012 for PCT Patent Application No. PCT/US11/043750, 11 pages.
Mi Swaco; "10k Super AutoChoke", product bulletin MS-04104, dated Aug. 2004, 4 pages.
IADC Well Control Europe; "Well Control in an Increasingly Complex and Changing Environment", Conference and Exhibition 2010, dated Apr. 13-14, 2010, 4 pages.

* cited by examiner

WELL CONTROL SYSTEMS AND METHODS

CROSS-REFERENCE TO RELATED APPLICATION(S)

This application is a national stage under 35 USC 371 of International Application No. PCT/US10/20122, filed on 5 Jan. 2010. The entire disclosure of this prior application is incorporated herein by this reference.

TECHNICAL FIELD

The present disclosure relates generally to equipment utilized and operations performed in conjunction with drilling a subterranean well and, in an embodiment described herein, more particularly provides well control systems and methods.

BACKGROUND

When drilling a wellbore at or nearly balanced, an influx of fluid into the wellbore from a formation intersected by the open hole can be experienced. It is common practice to stop drilling and shut in a well (close the blowout preventers and stop circulating) when undesired influxes are experienced. There are several well known procedures for dealing with large influxes (such as, the driller's method, the weight and wait method, etc.). However, these methods commonly rely on circulating the influx out of the wellbore through the rig's choke and manifold, with the choke being typically hydraulically actuated (but manually controlled) and incapable of responding quickly and in fine incremental steps to changing conditions to maintain a desired bottomhole pressure.

DETAILED DESCRIPTION

Figure 1:
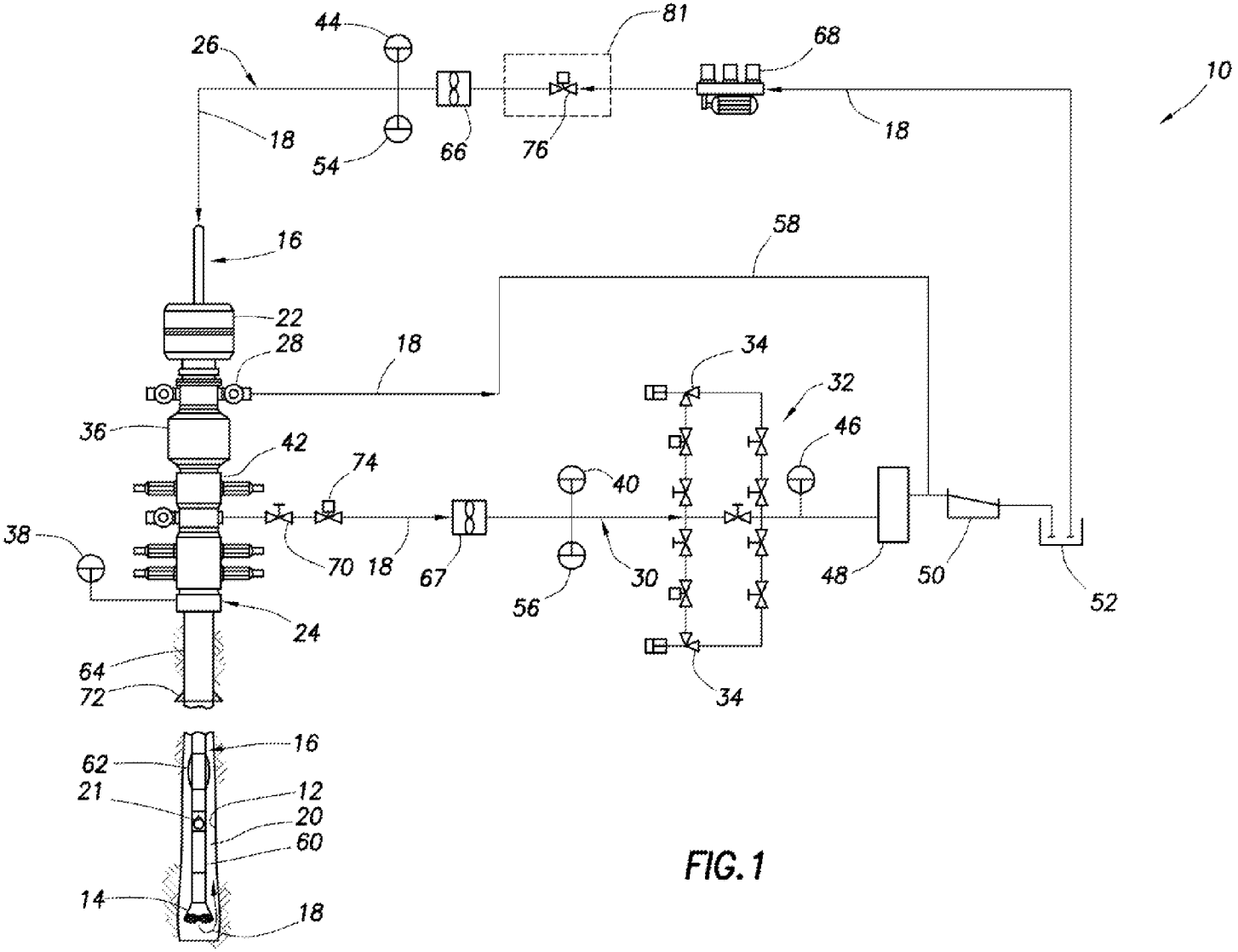
FIG. 1 is a schematic view of a well control system and method embodying principles of the present disclosure.

Improved well control systems and methods described below can use a hydraulics model to determine a wellhead pressure profile which should be applied to achieve and maintain a desired downhole pressure while circulating an undesired influx out of a wellbore in a well control situation. For example, the downhole pressure could be a bottomhole pressure needed to create an overbalance condition at the bottom of the wellbore to prevent further influxes, or the downhole pressure could be somewhat less than a pressure rating of a casing shoe, etc.

The desired downhole pressure can be maintained while circulating the influx out of the wellbore, reciprocating and rotating drill pipe in the wellbore, and making any needed adjustments in mud weight, etc. The hydraulics model and an automatically controlled choke interconnected in a fluid return line can track and control kill weight fluid as it is circulated to the bit, track and control the kill weight fluid as it flows up the annulus, track and control the kill weight fluid as gas therein reaches the surface and expands, control the discharge of the expanded gas into the rig mud gas separator system or any other types of separator systems and then quickly control discharge of liquid which follows the gas, and can control the pressure so precisely, that the pressure exerted by a gas bubble in the annulus can be controlled as it passes by a casing shoe (or any other chosen point in the annulus) on its way to the surface.

Preferably, the well control system includes at least the hydraulics model and the automatically controlled flow choking device. Examples of suitable automatically controllable chokes for use in the well control system and method is the AUTOCHOKE™ available from M-I Swaco of Houston, Tex. USA, and that described in U.S. Pat. No. 4,355,784, assigned to Warren Automatic Tool Company of Houston, Tex. USA. Other automatically controllable chokes may be used, if desired.

The hydraulics model determines the desired downhole pressure profile and the surface pressure profile required to achieve that downhole pressure, taking into account the wellbore configuration (e.g., utilizing a wellbore model), surface and downhole sensor measurements, equivalent circulating density, etc. The hydraulics model may make these determinations in real time or off-line. The real time operation of the hydraulics model would preferably be used during actual well control operations (e.g., while circulating out an influx, killing the well, etc.). The off-line operation of the hydraulics model may be used for planning purposes, exploring alternative scenarios, etc.

The flow choking device maintains the desired surface pressure by varying resistance to flow as needed. A backpressure pump or the rig pumps may be used to supply flow through a choke if needed, when there is no circulation through the drill string. Suitable techniques for supplying flow through the choke when flow through the drill string is ceased are described in International application serial no. PCT/US08/87686, filed on Dec. 16, 2008. Other techniques for supplying flow through the choke may be used, if desired.

The automatically controlled choke can take the place of a conventional rig choke manifold, or a rig choke manifold could be modified to include such an automatically controlled choke. The hydraulics model, wellbore model and data accumulation and storage can be similar to those used in managed pressure drilling (MPD) operations.

Another preferred feature of the new well control system is the ability to monitor and operate the well control system from a remote location. The wellsite system can be connected to a remote operations center (via any communications link, such as, landline, satellite, Internet, wireless, wide area network (WAN), telephony, etc.).

At the remote operations center, a well control expert is provided with a display of the pertinent sensor measurements, and can control and monitor the pressure profile provided by the hydraulics model, monitor the progress of the well control operation, manually override the pressure profile, manually control the flow choking device and valves, etc. In this manner, a well control expert is not needed at the wellsite. Instead, a single well control expert can monitor and control operations at several wellsites.

It is not necessary for a surface choke to be used in the well control system and method. Instead, a downhole choking/flow restricting device could be used. The downhole choke could, for example, comprise an inflatable packer on the drill string to choke flow through the annulus. Inflation of the packer and the resulting flow restriction could be controlled so that a desired downhole pressure is achieved/maintained.

The well control system could use a downhole flow measurement system and/or PWD (downhole pressure measurement system) for early influx detection. The downhole flow and/or pressure measurement system could detect changes in pressure, flow, fluid type, etc., so that an influx could be rapidly detected and communicated to the surface system, thereby enabling the influx to be controlled as soon as possible.

Preferably, the new well control system stops an undesired influx and circulates the influx out of a well, using a hydraulics model for determining a surface pressure profile and desired downhole pressure, and an automatically controlled choke or other flow restrictor. Such a system can prevent break down of a casing shoe, and can be remotely monitored and controlled.

Representatively and schematically illustrated in FIG. 1 is a well control system 10 and associated method which embody principles of the present disclosure. In the system 10, a wellbore 12 is drilled by rotating a drill bit 14 on an end of a drill string 16. Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A single or multiple, retrievable or permanent, non-return valve 21 (typically a flapper-type or plunger-type check valve) prevents flow of the drilling fluid 18 upward through the drill string 16 (e.g., when connections are being made in the drill string).

Control of bottom hole pressure is very important. Preferably, the bottom hole pressure is accurately controlled to prevent excessive loss of fluid into the earth formation surrounding the wellbore 12, undesired fracturing of the formation, undesired influx of formation fluids into the wellbore, etc. In an overbalanced drilling operation performed using the system 10, it is desired to maintain pressure in the annulus 20 greater than pore pressure in the formation surrounding the uncased or open hole section of the wellbore 12.

During normal drilling operations, the drilling fluid 18 exits the wellhead 24 via a wing valve 28 in communication with the annulus 20. The valve 28 may be associated with a diverter 22 connected above an annular blowout preventer 36, or a bell nipple may be used connected above the annular blowout preventer. The fluid 18 then flows (typically by gravity feed) through a mud return line 58 to a shaker 50 and mud pit 52.

The fluid 18 is pumped from the mud pit 52 by a rig mud pump 68. The pump 68 pumps the fluid 18 through a standpipe manifold 81 (schematically depicted in FIG. 1 as including only a valve 76), and then through a standpipe line 26 and into the drill string 16.

If a well control situation occurs (for example, if an undesired influx is received into the wellbore 12 from the formation surrounding the wellbore), then drilling is ceased and the annular blowout preventer 36 is closed about the drill string 16 to prevent any uncontrolled flow of mud, gas, etc. from the well. At this point, steps are taken to prevent further undesired influxes into the wellbore 12, and to circulate the undesired influx out of the annulus 20.

A high closing ratio (HCR) valve 74 in the blowout preventer stack 42 below the annular blowout preventer 36 is opened (a manual valve 70 having previously been opened), so that the fluid 18 can flow out of the annulus 20 through a choke line 30 to a choke manifold 32, which includes redundant chokes 34, of which one or two may be used at a time. Backpressure can be applied to the annulus 20 by variably restricting flow of the fluid 18 through the operative choke(s) 34 while circulating the influx out of the annulus 20.

The greater the restriction to flow through the choke 34, the greater the backpressure applied to the annulus 20. Thus, bottom hole pressure (or pressure at any location in the wellbore 12) can be conveniently regulated by varying the backpressure applied to the annulus 20.

A hydraulics model can be used, as described more fully below, to determine a pressure applied to the annulus 20 at or near the surface which will result in a desired downhole pressure, so that an operator (or an automated control system) can readily determine how to regulate the pressure applied to the annulus at or near the surface (which can be conveniently measured) in order to obtain the desired downhole pressure. Most preferably, the hydraulics model can determine a pressure profile (varied pressure over time) applied to the annulus 20 at or near the surface which will result in a corresponding desired pressure profile at a downhole location.

For example, it may be desired to maintain wellbore pressure at the influx location somewhat greater than pore pressure in the formation zone from which the influx originated (to thereby prevent further influxes) while suitably weighted fluid is pumped through the drill string 16 to the bit 14, while the weighted fluid is pumped up the annulus 20, while gas in the annulus expands as it nears the surface, while the gas is discharged through the choke line 30, and while the fluid discharged through the choke line changes between gas and liquid (and mixtures thereof). The ability of the choke 34 to variably restrict flow therethrough in very fine increments (and thereby precisely control backpressure applied to the annulus 20, and precisely control pressure at selected downhole locations) under control of the hydraulics model to achieve a desired pressure profile is far superior to past methods of manually controlling a hydraulically actuated choke during well control operations.

As another example, it may be desired to reduce the pressure applied to the annulus 20 as a gas bubble displaces in the annulus past a casing shoe 72, to thereby prevent break down of the casing shoe. After the gas bubble has displaced past the casing shoe 72, pressure in the annulus 20 can be increased as needed to prevent further influxes, and to circulate the undesired influx out of the wellbore 12. Although the reduced pressure in the annulus 20 may in some circumstances permit another undesired influx into the wellbore 12, such an influx would be of relatively short duration and could be readily circulated out of the annulus.

Pressure applied to the annulus 20 can be measured at or near the surface via a variety of pressure sensors 38, 40, each of which is in communication with the annulus. Pressure sensor 38 senses pressure below the blowout preventer (BOP) stack 42. Pressure sensor 40 senses pressure in the choke line 30 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56 and flowmeters 66, 67.

Not all of these sensors are necessary. For example, the system 10 could include only the flowmeter 66. However, input from the sensors is useful to the hydraulics model in determining what the pressure applied to the annulus 20 should be during the well control operation. Additional sensors could be included in the system 10, if desired.

In addition, the drill string 16 may include its own sensors 60, for example, to directly measure bottom hole pressure. Such sensors 60 may be of the type known to those skilled in the art as pressure while drilling (PWD), measurement while drilling (MWD) and/or logging while drilling (LWD). These drill string sensor systems generally provide at least pressure measurement, and may also provide temperature measurement, detection of drill string characteristics (such as vibration, weight on bit, stick-slip, etc.), formation characteristics (such as resistivity, density, etc.) and/or other measurements. Various forms of telemetry (acoustic, pressure pulse, electromagnetic, etc.) may be used to transmit the downhole sensor measurements to the surface.

The sensors 60 may also include a flowmeter for measuring the flow rate of fluid in the annulus 20. A suitable flowmeter for use in the drill string 16 is described in U.S. Pat. No. 6,585,044, assigned to the assignee of the present application. Other downhole annulus fluid flowmeters may be used, if desired.

Note that the separator 48 could be a 3 or 4 phase separator, or an atmospheric mud gas separator (sometimes referred to as a "poor boy degasser"). However, the separator 48 is not necessarily used in the system 10.

It should be understood that the chokes 34 are only one type of flow choking device which can be used to variably restrict flow of the fluid 18 from the annulus 20. Another type of flow choking device is a back pressure controller 84, which can restrict flow downstream of a closed separation system (see FIG. 3). Yet another type of flow choking device can restrict flow through the annulus 20 downhole. For example, an annulus flow restrictor 62 in the form of an inflatable packer can be interconnected in the drill string 16 and variably inflated as desired to variably restrict flow through the annulus 20 and apply a variable backpressure to the annulus below the restrictor. It may be preferable to position the restrictor 62 within a casing string 64, so that pressure applied to the casing shoe 72 can be controlled using the restrictor.

Figure 2:
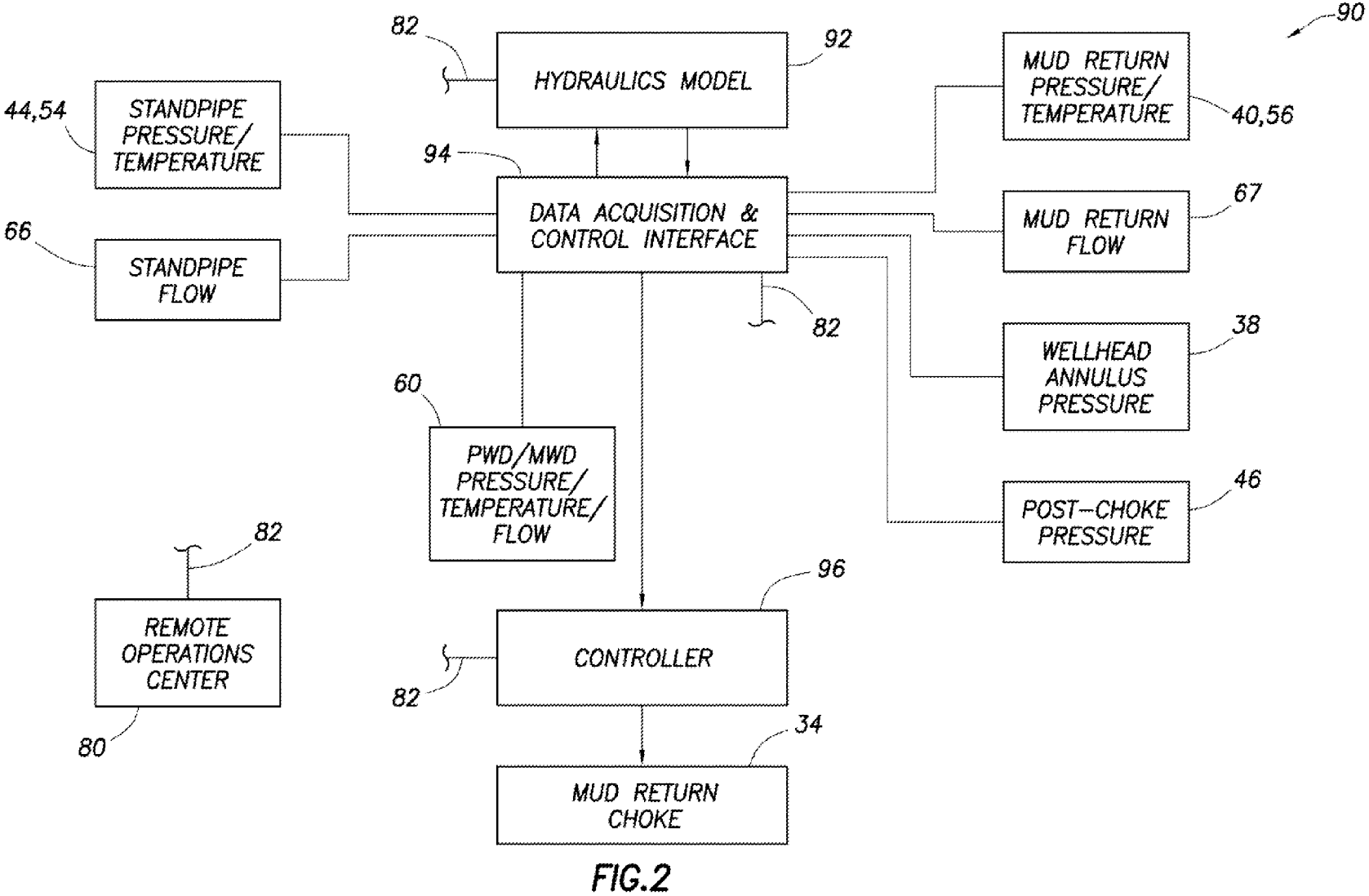
FIG. 2 is a schematic diagram of pressure and flow control elements in the well control system and method.

Representatively illustrated in FIG. 2 is a pressure and flow control system 90 which may be used in conjunction with the well control system 10 and associated method of FIG. 1. The control system 90 is preferably automated, although human intervention may be used, for example, to safeguard against improper operation, initiate certain routines, update parameters, etc.

The control system 90 includes a hydraulics model 92, a data acquisition and control interface 94 and a controller 96 (such as a programmable logic controller or PLC, a suitably programmed computer, etc.). Although these elements 92, 94, 96 are depicted separately in FIG. 2, any or all of them could be combined into a single element, or the functions of the elements could be separated into additional elements, other additional elements and/or functions could be provided, etc.

The hydraulics model 92 is used in the control system 90 to determine the desired annulus pressure/profile at or near the surface to achieve the desired downhole pressure/profile. Data such as well geometry, fluid properties and offset well information (such as geothermal gradient and pore pressure gradient, etc.) can be utilized by the hydraulics model 92 in making this determination, as well as real-time sensor data acquired by the data acquisition and control interface 94.

Thus, there is a continual two-way transfer of data and information between the hydraulics model 92 and the data acquisition and control interface 94. For the purposes of this disclosure, it is important to appreciate that the data acquisition and control interface 94 operates to maintain a substantially continuous flow of real-time data from the sensors 44, 54, 66, 60, 46, 38, 40, 56, 67 to the hydraulics model 92, so that the hydraulics model has the information it needs to adapt to changing circumstances and to update the desired annulus pressure/profile, and the hydraulics model operates to supply the data acquisition and control interface substantially continuously with a value for the desired annulus pressure/profile.

A suitable hydraulics model for use as the hydraulics model 92 in the control system 90 is REAL TIME HYDRAULICS™ provided by Halliburton Energy Services, Inc. of Houston, Tex. USA. Another suitable hydraulics model for use as the hydraulics model 92 in the control system 90 is Drilling Fluids Graphics (DFG) provided by Halliburton Energy Services, Inc. of Houston, Tex. USA. Yet another suitable hydraulics model is provided under the trade name IRIS™, and a still further is available from SINTEF of Trondheim, Norway. Any suitable hydraulics model may be used in the control system 90 in keeping with the principles of this disclosure.

A suitable data acquisition and control interface for use as the data acquisition and control interface 94 in the control system 90 are SENTRY™ and INSITE™ provided by Halliburton Energy Services, Inc. Any suitable data acquisition and control interface may be used in the control system 90 in keeping with the principles of this disclosure.

The controller 96 operates to maintain a desired setpoint annulus pressure by controlling operation of the fluid return choke 34, the subsurface annulus flow restrictor 62, or other flow choking device. When an updated desired annulus pressure is transmitted from the data acquisition and control interface 94 to the controller 96, the controller uses the desired annulus pressure as a setpoint and controls operation of the flow choking device in a manner (e.g., increasing or decreasing flow through the device as needed) to maintain the setpoint pressure in the annulus 20.

This is accomplished by comparing the setpoint pressure to a measured annulus pressure (such as the pressure sensed by any of the sensors 38, 40, 60), and increasing flow through the flow choking device if the measured pressure is greater than the setpoint pressure, and decreasing flow through the device if the measured pressure is less than the setpoint pressure. Of course, if the setpoint and measured pressures are the same, then no adjustment of the device is required. This process is preferably automated, so that no human intervention is required, although human intervention may be used if desired.

A remote operations center 80 can be used to monitor the well control operation from any remote location. The remote operations center 80 can monitor the hydraulics model 92, the data acquisition and control interface 94 and/or the controller 96 via a communications link 82 (such as, landline, satellite, Internet, wireless, wide area network (WAN), telephony, etc.). In this manner, a well control expert at the remote operations center 80 can monitor the well control operation, without a need to actually be present at the wellsite.

Furthermore, any or all of the well control operations can be controlled from the remote operations center 80. For example, it may be desirable to implement changes to or update the hydraulics model 92, implement changes to the data acquisition and control interface 94, directly control operation of the controller 96, etc., from the remote operations center 80. In this manner, a well control expert at the remote operations center 80 can adjust or override any important function of the control system 90, in order to ensure that the well control operation is successful.

Figure 3:
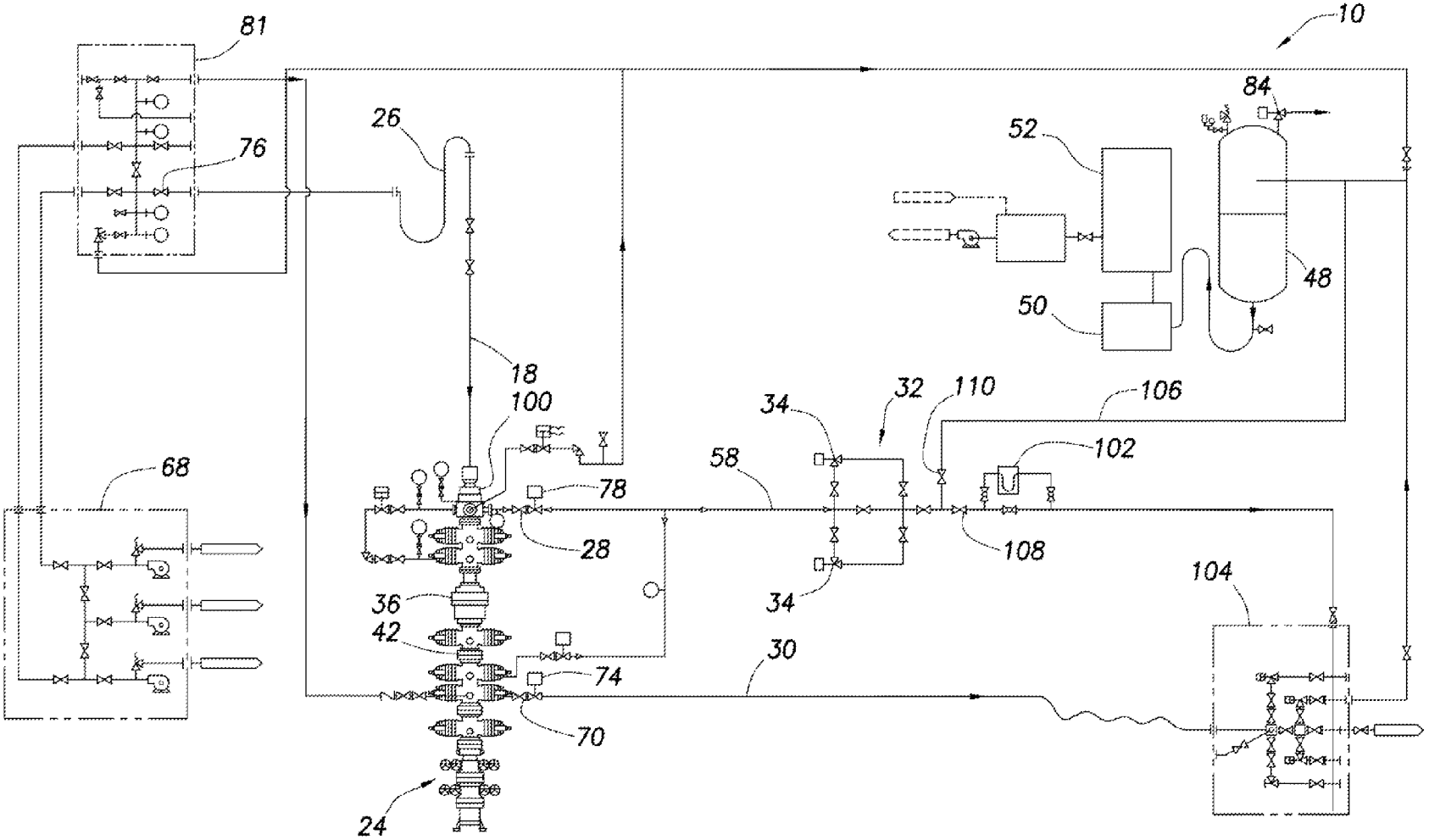
FIG. 3 is a schematic view of another configuration of the well control system and method.

Referring additionally now to FIG. 3, another configuration of the well control system 10 is representatively illustrated. This configuration of the system 10 is suitable for use in managed pressure and/or underbalanced drilling operations.

In typical managed pressure drilling, it is desired to maintain the downhole pressure just greater than the pore pressure of the formation, without exceeding a fracture pressure of the formation. In typical underbalanced drilling, it is desired to maintain the downhole pressure somewhat less than the pore pressure, thereby obtaining a controlled influx of fluid from the formation.

Nitrogen or another gas, or another lighter weight fluid, may be added to the drilling fluid 18 for pressure control. This technique is useful, for example, in underbalanced drilling operations.

In the system 10, additional control over the bottom hole pressure is obtained by closing off the annulus 20 (e.g., isolating it from communication with the atmosphere and enabling the annulus to be pressurized at or near the surface) using a rotating control device 100 (RCD, also known as a rotating control head, rotating blowout preventer, etc.). The RCD 100 seals about the drill string 16 above the wellhead 24 while drilling.

Although not shown in FIG. 3, the drill string 16 would extend upwardly through the RCD 100 for connection to, for example, a rotary table (not shown), a standpipe line 26, kelley (not shown), a top drive and/or other conventional drilling equipment. Various conventional details of the system 100, and the wellbore 12 below the wellhead 24 are not shown in FIG. 3 for clarity of illustration. Any of the features of the system 10 as depicted in FIG. 1 may be included in the configuration of FIG. 3.

In the configuration of FIG. 3, during normal managed pressure drilling operations, the fluid 18 flows through mud return line 58 to the choke manifold 32. Backpressure is applied to the annulus 20 by variably restricting flow of the fluid 18 through the operative choke(s) 34.

A Coriolis flowmeter 102 (or any other type of flow measurement device) is connected downstream of the choke manifold 32 to measure the flow rate of the fluid 18 which flows through the choke manifold. The flowmeter 102 in this configuration would also be connected to the data acquisition and control interface 94 described above. Any of the other sensors described above may also be used in the configuration of FIG. 3 during normal drilling operations, and during well control operations.

If an undesired influx occurs, it is not necessary to switch flow of the fluid 18 to another rig choke manifold 104. Instead, the undesired influx can be circulated out of the wellbore 12, and further undesired influxes can be prevented, while continuing to use the choke manifold 32 to maintain a desired downhole pressure/profile as described above.

However, a typical Coriolis flowmeter 102 may not have a sufficient pressure rating for use in well control operations, so a bypass flow line 106 in conjunction with valves 108, 110 may be used to isolate the flowmeter 102 from pressure downstream of the choke manifold 32 during well control operations. The bypass flow line 106 can be appropriately designed to convey relatively high pressure fluid 18 from the choke manifold 32 to the separator 48.

In the event that the capabilities of the choke 34, manifold 32 and/or pressure and flow control system 90 are exceeded in a well control operation, the rig choke manifold 104 can be used if needed for well control. To do so, HCR valve 74 can be opened and another HCR valve 78 can then be closed to thereby direct flow of the fluid 18 to the rig choke manifold 104.

Figure 4:
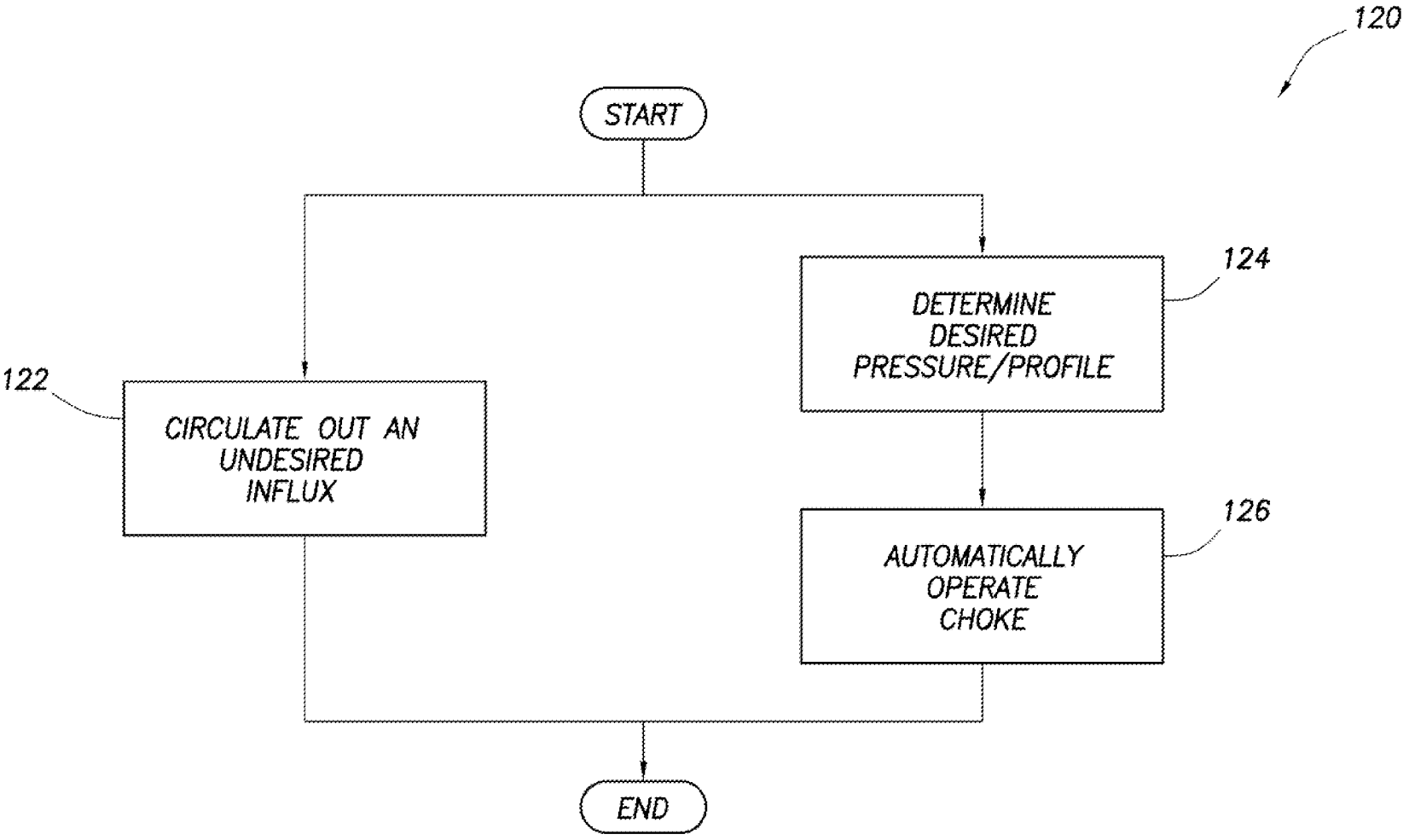
FIG. 4 is a schematic flowchart of steps in the well control method.

Referring additionally to FIG. 4, the well control method 120 described above is representatively illustrated in flowchart form. In a step 122 of the method 120, the undesired influx is circulated out of, or otherwise removed from, the wellbore 12. Concurrent with the circulating step 122, the hydraulics model 92 determines a desired downhole pressure/profile in a step 124, and a flow choking device (such as the choke 34 and/or annular flow restrictor 62, etc.) is automatically operated to achieve/maintain the desired pressure/profile in a step 126.

Thus, the method 120 may include removing from a wellbore 12 an undesired influx from a formation into the wellbore; determining a desired pressure profile with a hydraulics model 92; and automatically operating a flow choking device (such as the choke 34 and/or annular flow restrictor 62, etc.) while removing the undesired influx from the wellbore, thereby influencing an actual pressure profile toward the desired pressure profile.

Drilling of the wellbore 12 is preferably ceased while removing the undesired influx from the wellbore.

The flow choking device may comprise the choke 34 which regulates flow from the annulus 20 surrounding the drill string 16 to a mud gas separator 48. The choke 34 may be positioned at a surface facility. The flow choking device may alternatively, or additionally, comprise a subsurface annulus flow restrictor 62.

Automatically operating the flow choking device in step 126 may comprise variably restricting flow at the surface from the annulus 20 surrounding the drill string 16. Alternatively, or in addition, automatically operating the flow control device may comprise variably restricting flow through the annulus 20 downhole.

A backpressure pump (or the rig's pumps via a bypass) may be used to supply flow through the flow choking device when the fluid 18 is not circulated through the drill string 16 and annulus 20. The use of a backpressure pump to supply flow is described in U.S. Pat. Nos. 7,044,237 and 6,904,981, and the use of rig pumps to supply flow is described in U.S. Pat. No. 7,185,719 and International Application No. PCT/US08/87686.

Automatically operating the flow control device may comprise maintaining a desired surface pressure set point, and/or maintaining a desired subsurface pressure set point. The desired pressure set point may change over time (as determined by the hydraulics model), in which case a desired pressure profile (variable pressure set point over time) can be maintained.

Automatically operating the flow control device may comprise maintaining pressure at a selected location in the wellbore 12 at a predetermined set point pressure/profile. For example, bottom hole pressure and/or pressure at an influx location may be maintained at a set point, and pressure at the casing shoe 72 (or any other location, such as, a weak formation exposed to the wellbore) may be maintained at a set point below that which would otherwise cause the casing shoe to break down (or cause fracturing of a weak formation, etc.).

The flow control device can maintain pressure at the predetermined set point pressure/profile, and can control gas expansion as it rises to the surface to thereby control bottom hole pressure, even without the fluid 18 circulating through the drill string 16 and annulus 20. For example, if the rig pumps 68 happen to malfunction, a backpressure pump can be used to supply flow through the flow control device.

Even without a backpressure pump or other source of fluid flow, the flow control device can control release of gas from the annulus 20 in a manner which will control bottom hole pressure to a desired pressure set point/profile and/or prevent bottom hole pressure and/or pressure at a certain location in the wellbore from exceeding a pressure set point. Thus, the method 120 can be performed, even though no pump supplies fluid flow to the upstream side of the flow choking device. Automatically operating the flow choking device while removing the undesired influx from the wellbore 12 can be performed without a pump (such as rig pumps 68 or a backpressure pump) supplying fluid flow to an upstream side of the flow choking device.

The well control method 120 may also include monitoring the flow choking device and hydraulics model 92 at a location remote from the wellbore 12. The method 120 may include operating the flow choking device from the remote location, modifying the hydraulics model 92 from the remote location, and/or modifying the desired pressure/profile from the remote location.

Viewed from another perspective, the well control method 120 can include removing from the wellbore 12 an undesired influx from a formation into the wellbore 12; while removing the undesired influx from the wellbore 12, determining a desired pressure profile with the hydraulics model 92; and in response to determining the desired pressure profile, automatically operating a flow choking device while removing the undesired influx from the wellbore 12.

From yet another perspective, the well control method 120 can include removing from the wellbore 12 an undesired influx from a formation into the wellbore 12; determining a desired wellbore pressure with the hydraulics model 92, the desired wellbore pressure preventing further influx into the wellbore 12 while removing the undesired influx from the wellbore 12; and automatically operating a flow choking device while removing the undesired influx from the wellbore 12, thereby influencing an actual wellbore pressure toward the desired wellbore pressure.

One benefit which may result from use of the above-described well control systems 10 and methods 120 is that the automatically controlled flow choking device when used in conjunction with the hydraulics model 92 and the remainder of the pressure and flow control system 90 can rapidly respond to changing conditions and thereby safely remove the undesired influx from the wellbore and prevent further undesired influxes.

It is to be understood that the various embodiments of the present disclosure described herein may be utilized in various orientations, and in various configurations, without departing from the principles of this disclosure. The embodiments are described merely as examples of useful applications of the principles of the disclosure, which is not limited to any specific details of these embodiments. In the above description of the representative embodiments of the disclosure, directional terms, such as "above", "below", "upper", "lower", etc., are used for convenience in referring to the accompanying drawings.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well control method, comprising:

removing from a wellbore an undesired influx from a formation into the wellbore;

determining a desired pressure profile with a hydraulics model, wherein the hydraulics model provides a desired setpoint pressure which varies as the undesired influx displaces through the wellbore; and automatically and adjustably operating a flow choking device in response to determining a desired pressure profile, thereby influencing an actual wellbore pressure toward the desired setpoint pressure.

2. The well control method of claim 1, wherein drilling of the wellbore is ceased while removing the undesired influx from the wellbore.

3. The well control method of claim 1, wherein the flow choking device comprises a choke which regulates flow from an annulus surrounding a drill string to a mud gas separator.

4. The well control method of claim 1, wherein the flow choking device comprises a choke positioned at a surface facility.

5. The well control method of claim 1, wherein the flow choking device comprises a subsurface annulus flow restrictor.

6. The well control method of claim 1, wherein automatically operating the flow choking device further comprises variably restricting flow at the surface from an annulus surrounding a drill string.

7. The well control method of claim 1, wherein automatically operating the flow control device further comprises variably restricting flow downhole through an annulus surrounding a drill string.

8. The well control method of claim 1, wherein automatically operating the flow control device further comprises maintaining a desired surface pressure set point.

9. The well control method of claim 1, wherein automatically operating the flow control device further comprises maintaining a desired subsurface pressure set point.

10. The well control method of claim 1, wherein automatically operating the flow control device further comprises maintaining pressure at a selected location in the wellbore at a predetermined single, multiple or changing set point.

11. The well control method of claim 10, wherein the selected location is at a casing shoe.

12. The well control method of claim 1, further comprising monitoring the flow choking device and hydraulics model at a location remote from the wellbore.

13. The well control method of claim 12, further comprising operating the flow choking device from the remote location.

14. The well control method of claim 12, further comprising modifying the hydraulics model from the remote location.

15. The well control method of claim 12, further comprising modifying the desired pressure profile from the remote location.

16. The well control method of claim 1, wherein automatically operating the flow choking device while removing the undesired influx from the wellbore is performed without a pump supplying fluid flow to an upstream side of the flow choking device.

17. A well control method, comprising:

removing from a wellbore an undesired influx from a formation into the wellbore;

while removing the undesired influx from the wellbore, determining a desired pressure profile with a hydraulics model, wherein the hydraulics model provides a desired setpoint pressure which varies as the undesired influx displaces through the wellbore; and in response to identifying a difference between an actual wellbore pressure and the desired setpoint pressure, automatically and adjustably operating a flow choking device while removing the undesired influx from the wellbore.

18. The well control method of claim 17, wherein drilling of the wellbore is ceased while removing the undesired influx from the wellbore.

19. The well control method of claim 17, wherein the flow choking device comprises a choke which regulates flow from an annulus surrounding a drill string to a mud gas separator.

20. The well control method of claim 17, wherein the flow choking device comprises a choke positioned at a surface facility.

21. The well control method of claim 17, wherein the flow choking device comprises a subsurface annulus flow restrictor.

22. The well control method of claim 17, wherein automatically operating the flow choking device further comprises variably restricting flow at the surface from an annulus surrounding a drill string.

23. The well control method of claim 17, wherein automatically operating the flow control device further comprises variably restricting flow downhole through an annulus surrounding a drill string.

24. The well control method of claim 17, wherein automatically operating the flow control device further comprises maintaining a desired single, multiple or changing surface pressure set point.

25. The well control method of claim 17, wherein automatically operating the flow control device further comprises maintaining a desired subsurface pressure set point.

26. The well control method of claim 17, wherein automatically operating the flow control device further comprises maintaining pressure at a selected location in the wellbore at a predetermined set point.

27. The well control method of claim 26, wherein the selected location is at a casing shoe.

28. The well control method of claim 17, further comprising monitoring the flow choking device and hydraulics model at a location remote from the wellbore.

29. The well control method of claim 28, further comprising operating the flow choking device from the remote location.

30. The well control method of claim 28, further comprising modifying the hydraulics model from the remote location.

31. The well control method of claim 28, further comprising modifying the desired pressure profile from the remote location.

32. The well control method of claim 17, wherein automatically operating the flow choking device while removing the undesired influx from the wellbore is performed without a pump supplying fluid flow to an upstream side of the flow choking device.

33. A well control method, comprising:

removing from a wellbore an undesired influx from a formation into the wellbore;

determining a desired wellbore pressure with a hydraulics model, wherein the desired wellbore pressure varies as the undesired influx displaces through the wellbore; and automatically and adjustably operating a flow choking device in response to determining a desired pressure profile, thereby influencing an actual wellbore pressure toward the desired wellbore pressure.

34. The well control method of claim 33, wherein drilling of the wellbore is ceased while removing the undesired influx from the wellbore.

35. The well control method of claim 33, wherein the flow choking device comprises a choke which regulates flow from an annulus surrounding a drill string to a mud gas separator.

36. The well control method of claim 33, wherein the flow choking device comprises a choke positioned at a surface facility.

37. The well control method of claim 33, wherein the flow choking device comprises a subsurface annulus flow restrictor.

38. The well control method of claim 33, wherein automatically operating the flow choking device further comprises variably restricting flow at the surface from an annulus surrounding a drill string.

39. The well control method of claim 33, wherein automatically operating the flow control device further comprises variably restricting flow downhole through an annulus surrounding a drill string.

40. The well control method of claim 33, wherein automatically operating the flow control device further comprises maintaining a desired single, multiple or changing surface pressure set point.

41. The well control method of claim 33, wherein automatically operating the flow control device further comprises maintaining a desired subsurface pressure set point.

42. The well control method of claim 33, wherein automatically operating the flow control device further comprises maintaining pressure at a selected location in the wellbore at a predetermined set point.

43. The well control method of claim 42, wherein the selected location is at a casing shoe.

44. The well control method of claim 33, further comprising monitoring the flow choking device and hydraulics model at a location remote from the wellbore.

45. The well control method of claim 44, further comprising operating the flow choking device from the remote location.

46. The well control method of claim 44, further comprising modifying the hydraulics model from the remote location.

47. The well control method of claim 44, further comprising modifying the desired wellbore pressure from the remote location.

48. The well control method of claim 33, wherein automatically operating the flow choking device while removing the undesired influx from the wellbore is performed without a pump supplying fluid flow to an upstream side of the flow choking device.

* * * * *